US006102010A

United States Patent [19]

Isozumi et al.

[11] Patent Number: 6,102,010

[45] Date of Patent: Aug. 15, 2000

[54] FUEL SUPPLYING APPARATUS

[75] Inventors: Shuzo Isozumi; Masahiko Fujita; Tatsuya Ikegami, all of Tokyo, Japan

[73] Assignee: Mitsubishi Denki Kabushiki Kaisha, Tokyo, Japan

[21] Appl. No.: 09/061,063

[22] Filed: Apr. 16, 1998

[30] Foreign Application Priority Data

Sep. 25, 1997 [JP] Japan ..... 9-260416

[51] Int. Cl.[7] ..... F02M 33/04

[52] U.S. Cl. ..... 123/506; 123/446; 123/458; 123/514

[58] Field of Search ..... 123/510, 511, 123/457, 458, 446, 447, 514, 506, 467

[56] References Cited

U.S. PATENT DOCUMENTS

| | | | |
|---|---|---|---|
| 4,142,497 | 3/1979 | Long . | |
| 4,601,274 | 7/1986 | Seilly | 123/447 |
| 4,974,564 | 12/1990 | Laufer | 123/506 |
| 5,070,848 | 12/1991 | Mitsuyasu | 123/456 |
| 5,257,606 | 11/1993 | Willman et al. | 123/447 |
| 5,456,233 | 10/1995 | Felhofer | 123/456 |
| 5,558,068 | 9/1996 | Kunishima et al. | 123/516 |
| 5,598,817 | 2/1997 | Igarashi et al. | 123/516 |
| 5,626,121 | 5/1997 | Kushida et al. | 123/514 |
| 5,642,716 | 7/1997 | Ricco | 123/456 |
| 5,676,114 | 10/1997 | Tarr et al. | 123/456 |
| 5,701,873 | 12/1997 | Schneider . | |
| 5,727,525 | 3/1998 | Tsuzuki | 123/447 |
| 5,758,622 | 6/1998 | Rembold et al. | 123/456 |
| 5,884,597 | 3/1999 | Hiraku et al. | 123/447 |

FOREIGN PATENT DOCUMENTS

| | | |
|---|---|---|
| 481 964 | 4/1992 | European Pat. Off. . |
| 7-12029 | 1/1995 | Japan . |
| 7-83134 | 3/1995 | Japan . |
| 2 136 884 | 9/1984 | United Kingdom . |

*Primary Examiner*—Thomas N. Moulis
*Attorney, Agent, or Firm*—Sughrue, Mion, Zinn, Macpeak & Seas, PLLC

[57] ABSTRACT

The fuel supplying apparatus of the invention includes a fuel injector 1 injecting a fuel; a fuel tank 2; fuel paths 4 and 5 connecting the fuel injector 1 and the fuel tank 2; a low-pressure fuel pump 10 provided in the upstream; a high-pressure fuel pump 3 which is provided between the low-pressure fuel pump 10 and the fuel injector 1, a cylinder having a hole 41*a*, and a plunger 43 arranged reciprocally movably in the hole 41*a*, sucks and pressurizes the fuel through a suction port 5*c* into the fuel pressurizing chamber 45, discharges the pressurized fuel from a discharge port 4*d*, and pressure-transfers the fuel to the fuel injector 1; and a high-pressure regulator, which is provided between the high-pressure fuel pump 3 of the fuel path 4 and adjusts pressure of the fuel discharged from the high-pressure fuel pump 3.

9 Claims, 12 Drawing Sheets

FUEL SUPPLYING APPARATUS

BACKGROUND OF THE INVENTION

1. Field of the Invention

The present invention relates to a fuel supplying apparatus used for an in-cylinder injection type internal combustion engine, and more particularly, to a fuel supplying apparatus which permits minimization of pulsation width of the fuel pressure, stabilizes the quantity of injected fuel and makes it possible to stabilize the engine revolutions.

2. Description of the Related Art

As an internal combustion engine of a type injecting a fuel into cylinders of the engine, referred to as the in-cylinder injecting type internal combustion engine or the direct injecting type internal combustion engine, there is widely known a diesel engine. An in-cylinder injecting type engine has recently been proposed even for a spark igniting engine (gasoline engine). In such an in-cylinder injecting type internal combustion engine, there is a tendency toward increasing the fuel injecting pressure to achieve finer fuel atomizing, and reducing the fuel injecting period. In an engine provided with a supercharging mechanism, a high fuel injecting pressure meeting the supercharging pressure is required upon supercharging. In a fuel supplying system in an in-cylinder injecting type internal combustion engine, therefore, it is a common practice to achieve a sufficiently high fuel injecting pressure of, for example, 10 atm.

FIG. 14 is a schematic configuration diagram illustrating a conventional fuel supplying apparatus. In FIG. 14, a delivery pipe 1 has injectors 1*a* corresponding to the number of cylinders of an engine not shown. A high-pressure fuel pump 3 is arranged between the delivery pipe 1 and the fuel tank 2. The delivery pipe 1 and the high-pressure fuel pump 3 are connected by a high-pressure fuel path 4. The high-pressure fuel pump 3 and the fuel tank 2 are connected by a low-pressure fuel path 5. A filter 6 is provided at a fuel inlet port of the high-pressure fuel pump 3. A check valve 7 is provided on the discharge side of the high-pressure fuel pump 3. A drain 8 of the high-pressure fuel pump 3 is brought back to the fuel tank 2. The high-pressure fuel pump 3, the filter 6 and the check valve 7 are integrally formed as a high-pressure fuel pump 100.

A low-pressure fuel pump 10 is provided at the end of the low-pressure fuel path 5 on the side thereof facing the fuel tank 2. A filter 11 is provided at a fuel inlet port of the low-pressure fuel pump 10. A check valve 12 is provided in the low-pressure fuel path 5 on the discharge side of the low-pressure fuel pump 10. A low-pressure regulator 14 is provided in the low-pressure fuel path 5 between the high-pressure fuel pump 3 and the low-pressure fuel pump 10. A filter 15 is provided at a fuel inlet port of the low-pressure regulator 14. A drain 16 of the low-pressure regulator 14 is returned to the fuel tank 2.

The delivery pipe 1 has a further high-pressure fuel path 18 on the side opposite to the high-pressure fuel pump 3. A high-pressure regulator 20 is provided in this high-pressure fuel path 18. A drain 21 of the high-pressure regulator 20 is brought back to the fuel tank 2. The high-pressure regulator 20 is composed as a high-pressure regulator unit 110, and is installed at a prescribed position between the delivery pipe 1 and the fuel tank 2.

A fuel pressure sensor 22 is provided in the high-pressure fuel path 4.

In the fuel supplying apparatus having a configuration as described above, a fuel pressurized to some extent in the low-pressure fuel pump 10 is further pressurized in the high-pressure fuel pump 3, reaches the delivery pipe 1, and injected from the injector 1*a* into cylinders of an engine not shown. At this point, the discharge pressure from the low-pressure fuel pump 10 is stabilized within a prescribed range by the low-pressure regulator 14, and the discharge pressure from the high-pressure fuel pump 3 is stabilized within a prescribed range by the high-pressure regulator 20.

In the fuel supplying apparatus of this configuration, however, the discharge pressure of the fuel discharged from the high-pressure fuel pump 3 suffers a large pulsation. This pulsation is reflected to the high-pressure regulator 20, and a part thereof goes back on the high-pressure fuel pump 3 side, where it is enlarged further through resonance. More specifically, in the high-pressure fuel path 4 between the high-pressure fuel pump 3 and the high-pressure regulator 20, the delivery pipe 1 and the high-pressure fuel path 18, the pulsation produced in the high-pressure fuel pump 3 is enlarged through resonance with the reflected wave. This pulsation causes a variation of the quantity of fuel injected from the delivery pipe 1. This variation of the quantity of injected fuel causes an unstable air/fuel ratio, and unstable revolutions of the engine. Pulsation of fuel in the piping causes another problem of occurrence of abnormal sound. Particularly, when the high-pressure fuel pump 3 is of the single-cylinder type, this serious pulsation poses a difficult problem.

SUMMARY OF THE INVENTION

The present invention was developed to solve the problems as described above, and has an object to provide a fuel supplying apparatus which permits reduction of fuel pulsation, and stabilization of the quantity of injected fuel and engine revolutions.

In order to achieve the above object, according to one aspect of the present invention, there is provided a fuel supplying apparatus which comprises a fuel injector which injects a fuel into an internal combustion engine; a fuel tank for storing the fuel; a fuel path connecting the fuel injector and the fuel tank; a low-pressure fuel pump provided at the end of the fuel path on the side of said fuel tank; a high-pressure fuel pump provided between the low-pressure fuel pump and the fuel injector of the fuel path and having a fuel suction port, a fuel discharge port, a cylinder having a hole, a fuel pressurizing chamber formed on a part of the hole, and a plunger arranged reciprocally movably in the hole, and the high-pressure fuel pump sucking the fuel from the fuel path through the suction port into the fuel pressurizing chamber for pressurizing the same and discharging the pressurized fuel from the discharge port into the fuel path to pressure-feed the discharged fuel to the fuel injector by reciprocation work of the plunger; and a high-pressure regulator, which is provided between the high-pressure fuel pump and the fuel injector of the fuel path, for adjusting pressure of the fuel discharged from the high-pressure fuel pump.

According to another aspect of the present invention, there is provided a fuel supplying apparatus comprising a fuel injector which injects a fuel into an internal combustion engine; a fuel tank for storing the fuel; a fuel path connecting the fuel injector and the fuel tank; a low-pressure fuel pump provided at the end of the fuel path on the side of said fuel tank; a high-pressure fuel pump provided between the low-pressure fuel pump and the fuel injector of the fuel path and having a fuel suction port, a fuel discharge port, a cylinder having a hole, a fuel pressurizing chamber formed on a part of the hole, and a plunger arranged reciprocally movably in the hole, and the high-pressure fuel pump sucking the fuel from the fuel path through the suction port into the fuel pressurizing chamber for pressurizing the same and discharging the pressurized fuel from the discharge port into the fuel path to pressure-feed the discharged fuel to the fuel injector by reciprocation work of the plunger; and a high-pressure accumulator, which is provided between the high-pressure fuel pump and the fuel injector of the fuel path, for absorbing pulsation of the fuel discharged from the high-pressure fuel pump.

According to still another aspect of the present invention, there is provided a fuel supplying apparatus comprising a fuel injector which injects a fuel into an internal combustion engine; a fuel tank for storing the fuel; a fuel path connecting the fuel injector and the fuel tank; a low-pressure fuel pump provided at the end of the fuel path on the side of said fuel tank; a high-pressure fuel pump provided between the low-pressure fuel pump and the fuel injector of the fuel path and having a fuel suction port, a fuel discharge port, a cylinder having a hole, a fuel pressurizing chamber formed on a part of the hole, and a plunger arranged reciprocally movably in the hole, and the high-pressure fuel pump sucking the fuel from the fuel path through the suction port into the fuel pressurizing chamber for pressurizing the same and discharging the pressurized fuel from the discharge port into the fuel path to pressure-feed the discharged fuel to the fuel injector by reciprocation work of the plunger; a high-pressure regulator, which is provided between the high-pressure fuel pump and the fuel injector of the fuel path, for adjusting pressure of the fuel discharged from the high-pressure fuel pump; and a high-pressure accumulator, which is provided between the high-pressure fuel pump and the fuel injector of the fuel path, for absorbing pulsation of the fuel discharged from the high-pressure fuel pump.

According to a further aspect of the present invention, there is provided a fuel supplying apparatus, wherein the high-pressure regulator is provided integrally with the high-pressure fuel pump.

According to a still further aspect of the present invention, there is provided a fuel supplying apparatus, wherein the high-pressure regulator is provided integrally with the high-pressure fuel pump.

According to another aspect of the present invention, there is provided a fuel supplying apparatus, wherein the high-pressure regulator has a drain communicating with the fuel tank.

According to still another aspect of the present invention, there is provided a fuel supplying apparatus, wherein the high-pressure fuel pump has a drain communicating with the fuel tank, and the high-pressure regulator has a drain communicating with the drain of the high-pressure fuel pump.

According to a further aspect of the present invention, there is provided a fuel supplying apparatus, further comprising a check valve which is provided between the drain of the high-pressure fuel pump and the drain of the high-pressure regulator for preventing a fuel returned from the high-pressure regulator from going to the high-pressure fuel pump.

According to a still further aspect of the present invention, there is provided a fuel supplying apparatus, wherein the high-pressure fuel pump is of the single-cylinder type.

According to another aspect of the present invention, there is provided a fuel supplying apparatus, wherein the number of cam crests of a cam interlocking with a crank of an internal combustion engine which serves as driving means for reciprocating the plunger is smaller than the number of cylinders of the internal combustion engine.

According to still another aspect of the present invention, there is provided a fuel supplying apparatus, wherein the number of cam crests is a half the number of cylinders of the internal combustion engine.

According to a further aspect of the present invention, there is provided a fuel supplying apparatus, wherein the high-pressure fuel pump supplies the fuel to an internal combustion engine of the direct gasoline injecting type.

DESCRIPTION OF THE PREFERRED EMBODIMENTS

Embodiment 1

Figure 1:
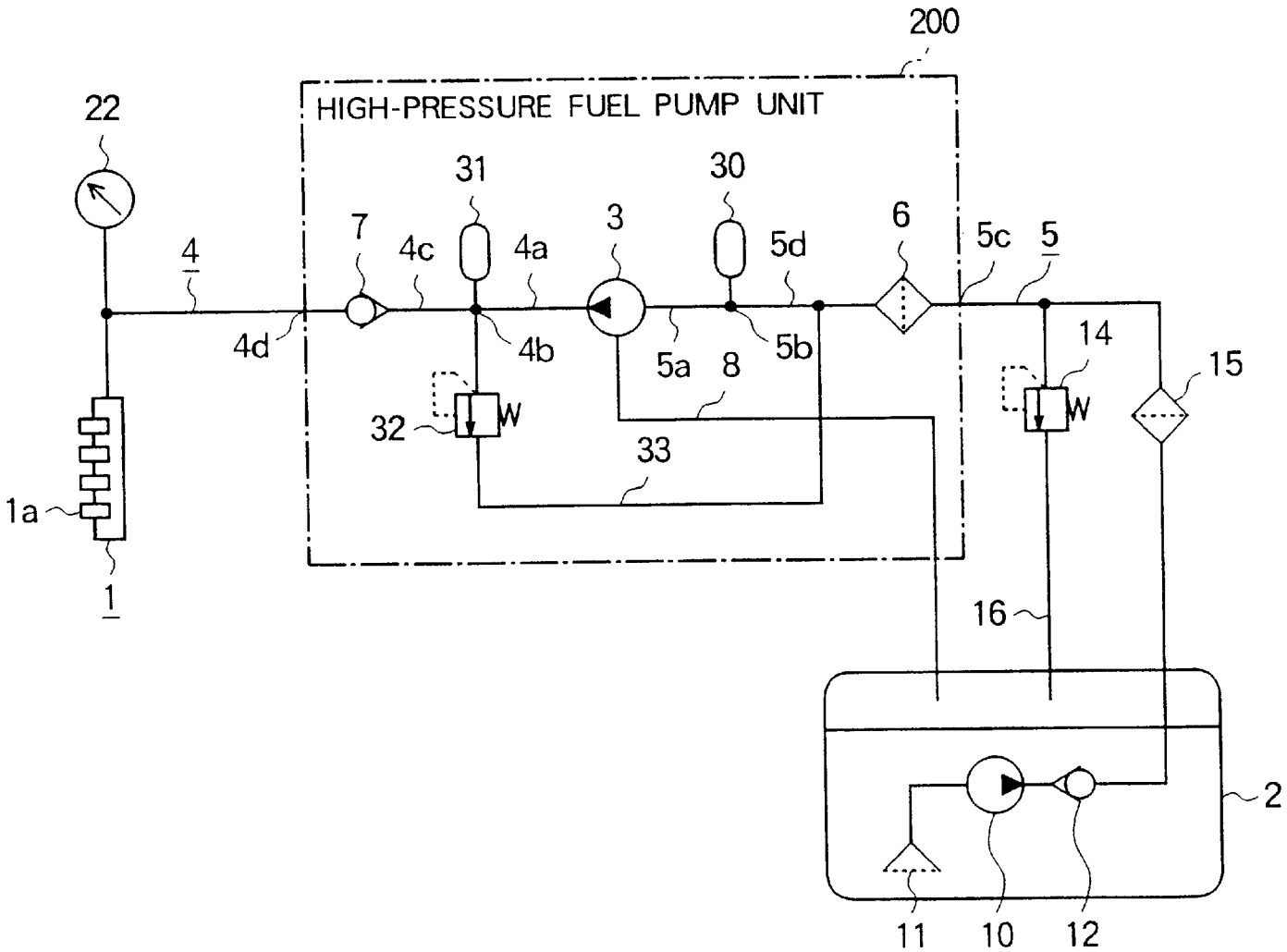
FIG. 1 is a schematic configuration diagram illustrating the fuel supplying apparatus of the present invention.
Figure 2:
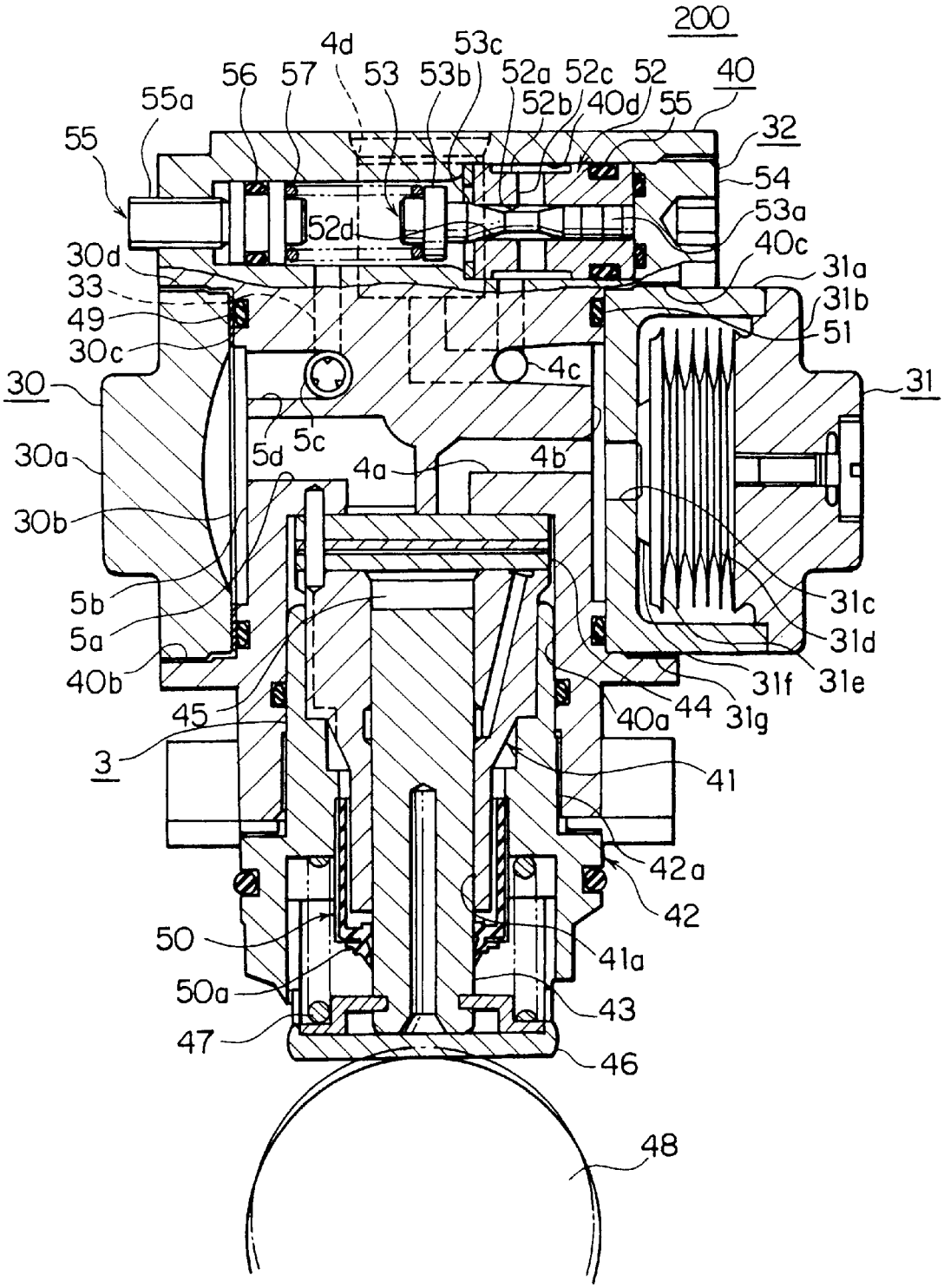
FIG. 2 is a sectional view of a high-pressure fuel pump of the fuel supplying apparatus of the invention.
Figure 3:
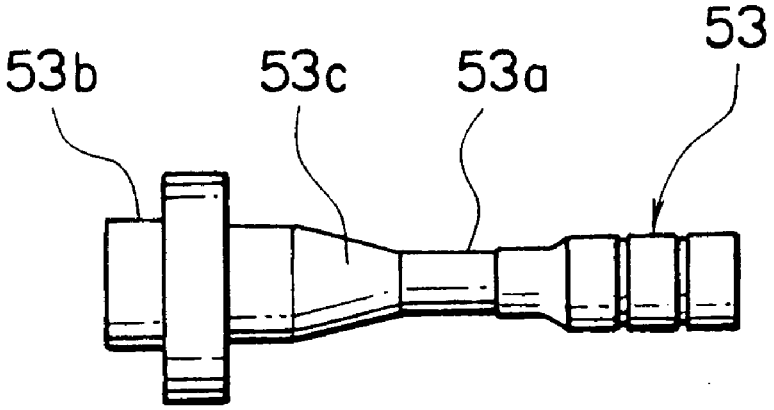
FIG. 3 is a side view of a spool of a high-pressure regulator.
Figure 4:
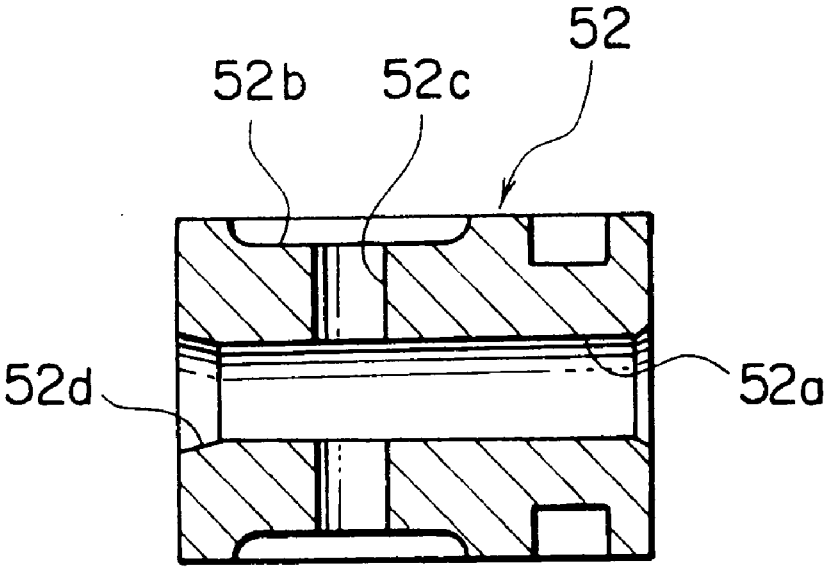
FIG. 4 is a sectional view of a cylindrical member of the high-pressure regulator.
Figure 5:
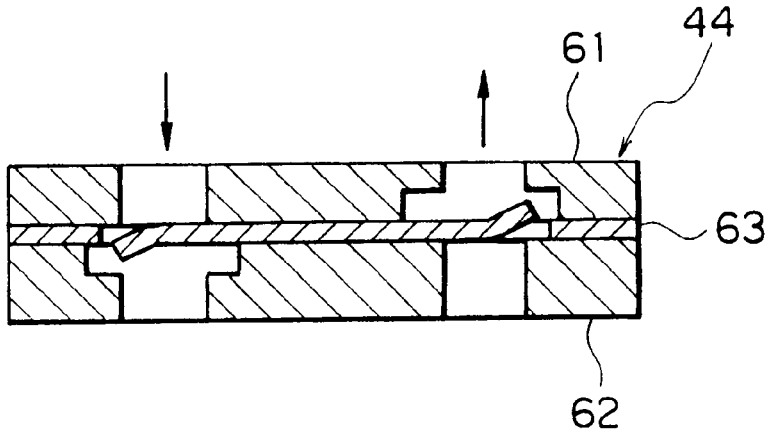
FIG. 5 is a schematic view of a reed valve.
Figure 6:
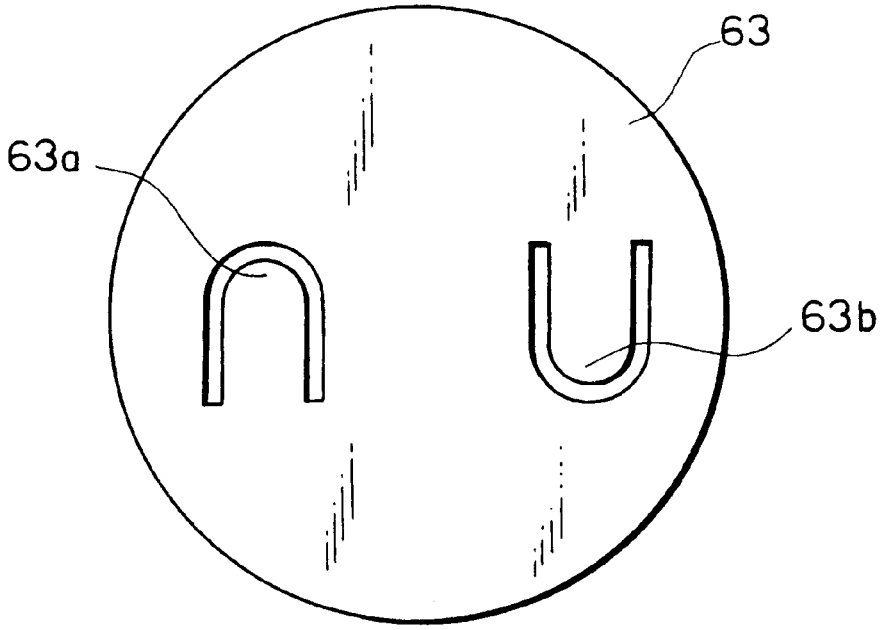
FIG. 6 is a plan view of a valve of the reed valve.

FIG. 1 is a schematic configuration diagram illustrating the fuel supplying apparatus of the present invention; FIG. 2 is a sectional view of a high-pressure fuel pump of the fuel supplying apparatus of the invention; FIG. 3 is a side view of a spool of a high-pressure regulator; FIG. 4 is a sectional view of a cylindrical member of the high-pressure regulator; FIG. 5 is a schematic view of a reed valve; and FIG. 6 is a plan view of a valve of the reed valve.

In FIG. 1, a delivery pipe 1, a fuel injecting device, has a plurality of injectors 1*a* in a number corresponding to the number of cylinders of an engine not shown. A high-pressure fuel pump 3 is arranged between the delivery pipe 1 and a fuel tank 2. The delivery pipe 1 and the high-pressure fuel pump 3 are connected by a high-pressure fuel path 4. The high-pressure fuel pump 3 and the fuel tank 2 are connected by a low-pressure fuel path 5. The high-pressure fuel path 4 and the low-pressure fuel path 5 form a fuel path connecting the delivery pipe 1 and the fuel tank 2. A filter 6 is provided at a fuel inlet port of the high-pressure fuel pump 3. A check valve 7 is provided on the discharge side of the high-pressure fuel pump 3. A drain 8 of the high-pressure fuel pump 3 is brought back to the fuel pump 2.

A low-pressure fuel pump 10 is provided at the end of the low-pressure fuel path 5 on the side thereof facing the fuel tank 2. A filter 11 is provided at a fuel inlet port of the low-pressure fuel pump 10. A check valve 12 is provided in the low-pressure fuel path on the discharge side of the low-pressure fuel pump 10. A low-pressure regulator 14 is provided in the low-pressure fuel path 5 between the high-pressure fuel pump 3 and the low-pressure fuel pump 10. A filter 15 is provided at a fuel inlet port of the low-pressure regulator 14. A drain 16 of the low-pressure regulator 14 is brought back to the fuel tank 2.

The high-pressure fuel pump 3 brings the fuel supplied by the low-pressure fuel path 5 further to a higher pressure and discharges it onto the delivery pipe 1 side. A damper 30 is provided on the side of the high-pressure fuel pump 3 facing the low-pressure fuel path 5, i.e., on the low-pressure side. A high-pressure accumulator 31 and a high-pressure regulator 32 are provided on the high-pressure side of the high-pressure fuel pump 3. A drain 33 of the high-pressure regulator 32 is returned to the fuel sucking side of the high-pressure fuel pump 3. The high-pressure fuel pump 3, the damper 30, the high-pressure accumulator 31, the high-pressure regulator 32, the filter 6 and the check valve 7 integrally form a high-pressure fuel pump unit 200.

FIG. 2 is a sectional view of a high-pressure fuel pump unit 200. A cylindrical recess 40*a* is formed below a casing 40. A substantially barrel-shaped cylinder 41 is tightened by a cylinder fixing member 42 in the recess 40*a*. A male screw 42*a* is threaded on the outer periphery of the cylinder fixing member 42 to engage with a female screw on the recess 40*a*. The cylinder 41 has a cylindrical hole 41*a* at the center thereof, and a cylindrical plunger 43 is slidingly arranged in this hole 41*a*. A suction path 5*a* for sucking the fuel and a discharge path 4 for discharging the fuel communicate with the hole 41*a*. A reed valve 44 for opening and closing the suction path 5*a* and the discharge path 4*a* is held and fixed between a bottom of the recess 40*a* and the cylinder 41. A fuel pressurizing chamber 45 is formed, surrounded by end faces of the reed valve 44 and the plunger 43 in a space above the hole 41*a* in FIG. 2.

A disk-shaped tappet 46 is fixed to the other end of the plunger 43 so that the main surface thereof forms right angles to the plunger 43. A coil-shaped spring 47 is compressed between the tappet 46 and the cylinder fixing member 42. The main surface of the tappet 46 on the side opposite to the plunger 43 is in contact with the cam face of the cam 48. The cam 48 is counted to a crank of an internal combustion engine so as to rotate by a turn for two turns of the crank. The fuel supplying apparatus of the invention is for a six-cylinder engine and the cam 48 has three crests. The cam 48 rotates along with rotation of the engine, and causes reciprocation of the plunger 43 by overcoming the restoring force of the spring 47.

A substantially cylindrical sealing member 50 is arranged between the plunger 43 and the cylinder fixing member 42. The sealing member 50 is manufactured through insert-forming so that rubber is integral with a cylindrical steel sheet. An 50*a* end of the sealing member 50 is formed into a double thin-wall shape known as a double ripple shape, and is closely and slidably attached to a side of the plunger 43. The other end of the sealing member 50 is secured to the cylinder fixing member 42. The sealing member 50 provides sealing so that the fuel leaking through the sliding surface formed between the cylinder 41 and the plunger 43 is prevented from leaking to the outside. The fuel accumulating in the sealing member 50 is returned to the fuel tank 2 through a drain 8 not shown in FIG. 2.

A recess 40*b* is formed to the left of the casing 40 in FIG. 2. A dumper 30 is tightened in this recess 40*b*. A suction path 5*b* communicating with the suction path 5*a* is formed in the form of a recess on the bottom of the recess 40*b*. The damper 30 comprises a thick disk-shaped case 30*a*, a metal diaphragm 30*b* made of a thin metal sheet, and an annular plate 30*c*. A gently-sloping dent is formed on a main surface of the case 30*a*. The metal diaphragm 30 is welded together with the case 30*a* by tightly closing so as to cover the dent. More specifically, a closed space is formed between the case 30*a* and the metal diaphragm 30*b* and seals the air therein. A male screw 30*d* is threaded on the outer periphery of the case 30*a*. In the recess 40*b*, on the other hand, a female screw engaging with the male screw 30*d* is formed. The damper 30 is sealed by an O-ring 49 and tightened with the recess 40*b* so as to cover the suction path 5*b* with the metal diaphragm 30 directed outside. The suction path 5*b* is communicated with a sucking port 5*c* by the suction path 5*d*. Upon production of a pulsation of pressure in the fuel running through the suction path 5*a*, the damper 30 causes the metal diaphragm 30*b* to move to the right and the left in FIG. 2 in response to the difference in pressure. It thus absorbs the pulsation in fuel pressure produced in the fuel in the suction path 5*a* by the high-pressure fuel pump 3.

To the right of the casing 40, on the other hand, a recess 40*c* is formed. A high-pressure accumulator 31 is secured to this recess 40*c*. A discharge path 4*b* communicating with a discharge path 4*a* is formed as a recess on the bottom of the recess 40*c*. The high-pressure accumulator 31 has a barrel-shaped bottomed cylinder 31*a* and a lid 31*b* for tightly closing this cylinder 31*a*. A throughhole 31*c* is pierced in the bottom of the cylinder 31*a*. A bellows 31*d* having a side fixed to the lid 31*b* is housed in the high-pressure accumulator 31. A high-pressure gas is sealed in the bellows 31*d*. A plate 31*e* is fixed to the leading end of the bellows 31*d*, and a rubber plate 31*f* is stuck to the main surface of the plate 31*e*. The bellows 31*d* brings the rubber plate 31*f* into close contact with the bottom of the cylinder 31*a* by the action of the high-pressure gas sealed therein to clog off the throughhole 31*c*. A male screw 31*g* is threaded on the outer periphery of the cylinder 31*a*. A female screw engaging with the male screw 31*g* is on the other hand formed on the recess 40*c*. The high-pressure accumulator 31 is sealed by an O-ring 51 and tightened to the recess 40*c* so as to cover the discharge path 4*b* against the inside of the bottom of the cylinder 31*a* so that the throughhole 31*c* communicates with the discharge path 4*b*.

The high-pressure accumulator 31 absorbs a pulsation of the fuel discharged onto the discharge path 4*b*. That is, when pressure of the fuel discharged onto the discharge path 4*b* is high, the bellows 31*d* contracts to the right in FIG. 2 to perform absorption, and when pressure is low, the bellows 31*d* operates to expand to the left in FIG. 2 to absorb the pulsation.

A discharge path 4*c* is further communicated with the discharge path 4*b* formed on the bottom of the recess 40*c*. The discharge path 4*c* branches in the middle and the both branch paths extend upward in FIG. 2. On one of the branch paths of the discharge path 4*c*, above the casing 40 in FIG. 2, a high-pressure regulator 32 is arranged. The other of the branch paths communicates with a discharge port 4*d* provided on the outer surface of the casing 40. The high-pressure regulator 32 is arranged in a passage hole 40*d* running through across the casing 40.

The high-pressure regulator 32 has a cylindrical member 52 fixed to a side in the passage hole 40*d* and forming a path in the passage hole 40, and a spool 53 movably arranged in the cylindrical member 52. The cylindrical member 52 is arranged in the passage hole 40*d*, tightened by a fixing member 54 from right in FIG. 2, and has a outer periphery sealed by an O-ring 55. As shown in FIG. 4, an annular groove 52*b* formed on the outer periphery and communication hole 52*c* communicating this annular groove 52*b* with a center hole 52*a* are formed in the cylindrical member 52.

The spool 53 takes substantially a bar shape and comprises a shaft section 53*a* housed movably in the cylindrical member 52, and a head section 53*b* formed at an end of the shaft section 53*a* and having a disk-shaped flange 53*b*. A tapered seat face 53*c* is formed at a prescribed position of the shaft section 53*a*. A seat 52*d* which can be brought into close contact with this seat face 53*c* and forms a fluid valve together with the seat face 53*c* is formed at an end of the cylindrical member 52.

Again as shown in FIG. 2, a spring pressure adjusting screw 55 is arranged on the side of the passage hole 40*d* opposite to the cylindrical member 52. The spring pressure adjusting screw 55 has an outer periphery sealed by an O-ring 56, a screw section 55*a* engaging with a female screw formed on the casing 40, and an end of the screw section 55*a* projecting outside. A spring 57 is compressed between the spring pressure adjusting screw 55 and a head 53*b* of the spool 53. The spring 57 imparts a force in the right direction in FIG. 2 to the spool 53. This imparted force is adjusted by rotating the spring pressure adjusting screw 55.

A drain 33 communicating with the suction port 5*c* is formed near the position where the spring 57 of the passage hole 40*d* is housed. The high-pressure regulator 32 adjusts pressure of the fuel flowing through the discharge path 4*c*. The fuel having passed from the high-pressure accumulator 31 side through the discharge path 4*c* to the high-pressure regulator 32 passes from the groove 52*b* formed on the outer periphery of the cylindrical member 52 through the communication hole 52*c* and the center hole 52*a* and reaches the fluid valve composed of the seat face 53*c* and the seat 52*d*. When the fuel pressure is higher than a prescribed pressure, the fuel overcomes the imparted force of the spring 57 causes the spool 53 to move to the left in FIG. 2, and passes through the drain 33 onto the sucking port 5*c* side. When the fuel pressure is lower than the prescribed pressure, the seat face 53*c* and the seat 52*d* are closed.

In FIG. 2, the filter 6 and the check valve 7 illustrated in FIG. 1 are now shown.

FIG. 5 is a schematic view illustrating the structure of the reed valve 44; and FIG. 6 is a plan view of the valve of the reed valve 44. The reed valve 44 comprises two plates 61 and 62, and a sheet-shaped valve 63 held therebetween. Two throughholes are formed at prescribed positions for allowing the fuel to pass through the two plates 61 and 62. The two throughholes respectively correspond to the suction path 5*a* and the discharge path 4*a* formed in the casing 40, and openings on one side thereof are larger to permit a valve body of the valve 63 to operate only in one direction. Two valve bodies 63*a* and 63*b* are formed at positions corresponding to the throughholes of the plates in the valve 63. The reed valve 44 causes the fuel to pass through the fuel pressurizing chamber 45 only in a direction as shown by an arrow in FIG. 5.

The high-pressure fuel pump unit 200 having a configuration as described above sucks a low-pressure fuel from the suction port 5*c*, pressurizes the fuel in the high-pressure fuel pump 3, and discharges the same from the discharge port 4*d*. In other words, the fuel is sucked from the suction port 5*c*, and enters the fuel pressurizing chamber 45 through the dumper 30 section and then the reed valve 44. Then, the fuel is pressurized by reciprocation of the plunger 43 and discharged from the discharge path 4*a*. The fuel having been discharged from the fuel pressurizing chamber 45 passes through the high-pressure accumulator 31 section, and is discharged from the discharge port 4*d* after passing through the high-pressure regulator 32. The fuel discharged from the high-pressure fuel pump unit 200 is directed toward the delivery pipe 1.

On the suction side of the high-pressure fuel pump 3 in these steps, pulsation produced by the high-pressure fuel pump 3 in the fuel to be sucked from the suction port 5*c* is absorbed by the damper 30. Pulsation produced by the high-pressure fuel pump 3 on the discharge side of the high-pressure fuel pump 3 is absorbed by the high-pressure accumulator 31. Further, the pressure of the discharged fuel is adjusted by the high-pressure regulator 32. The high-pressure regulator 32, closest to the high-pressure fuel pump 3, has a very small range in which it is affected by the reflected wave of pulsation, leading to non-occurrence of resonance. As a result, pulsation of the fuel pressure is reduced.

Figure 7:
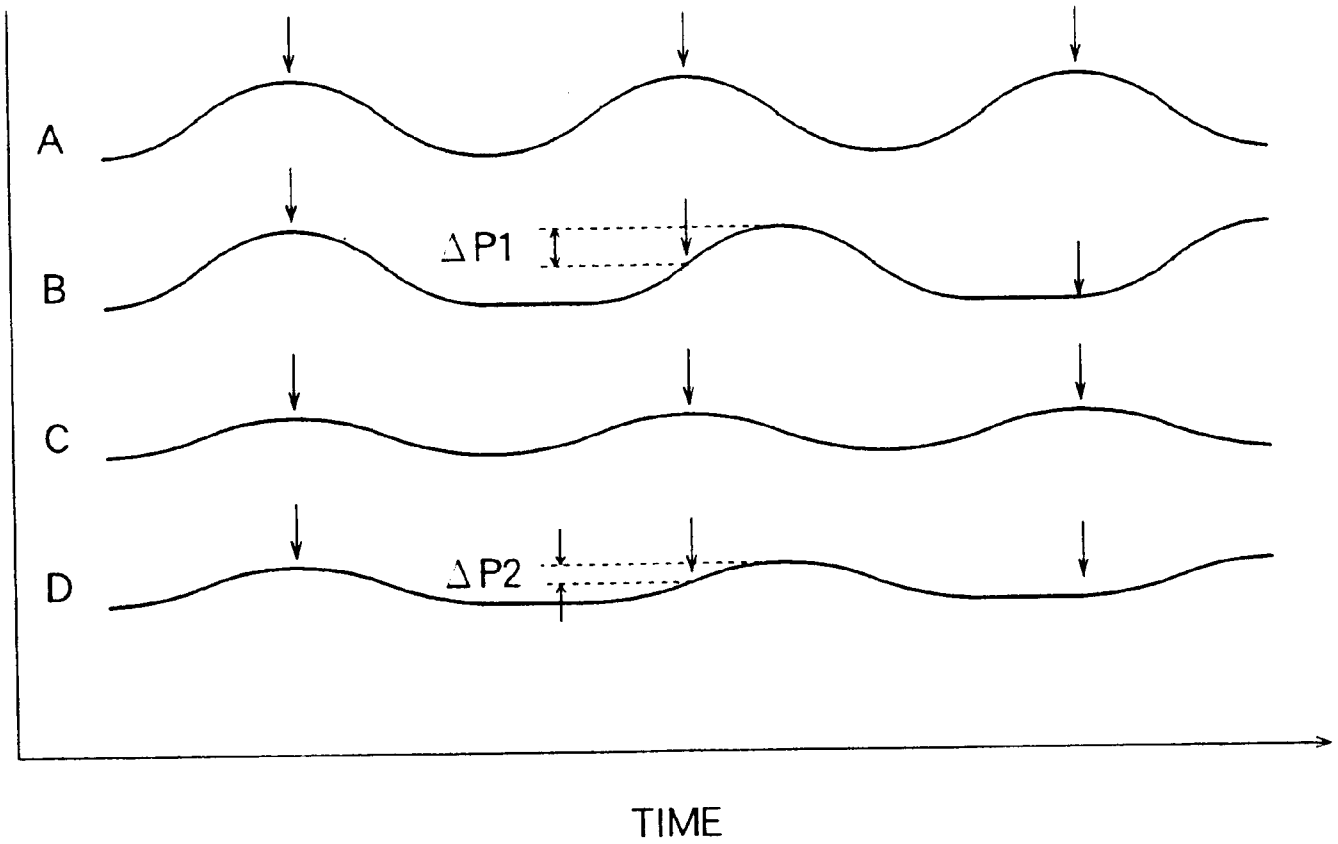
FIG. 7 is a time chart illustrating pulsation and timing of injection.

FIG. 7 is a time chart illustrating timing of pulsation and injection: the ordinate represents the fuel pressure, and the abscissa represents the time. In terms of the ordinate in which a higher position corresponds to a higher pressure, pulsation A on the top from among the four waveforms does not show the highest pressure, but the four waveforms are plotted with slight shifts among them to clearly show differences in timing. In FIG. 7, pulsation A in the delivery pipe 1 of the conventional fuel supplying apparatus has a very large pulsation width as shown in the graph. It has been the conventional practice to set a timing for injecting the fuel from the delivery pipe 1 so as to give a pulsation peak substantially as indicated by an arrow in the graph. If the number of cam crests for the high-pressure fuel pump is reduced in this apparatus, pulsation would take the form of pulsation B which would result in a large pressure difference p1 of the fuel upon injecting with a larger difference in the amount of injection, thus leading to unstable revolutions of the internal combustion engine. In the conventional apparatus, therefore, the number of cam crests has been set the same as the number of cylinders and the timing of injection has been caused to substantially agree with the pulsation peak.

Pulsation C for the high-pressure fuel pump 3 of this embodiment has however a smaller pulsation width because of the absorption by the high-pressure accumulator. In the apparatus of the present embodiment, reduction of the number of cam crests of the high-pressure fuel pump 3 results in pulsation D which poses no problem since the pressure difference p1 of the fuel upon injection is small, and the difference in the quantity of injection can be adjusted within an allowable range. This means that, if the pulsation width can be reduced, it is possible to select any timing of injection, i.e., the reciprocation of the plunger 43 can well be different from the number of cylinders of the engine. It is therefore possible to adopt a number of cam crests smaller than the number of cylinders of the engine. In the present embodiment, the high-pressure fuel pump 3 has a three-crest cam 48 for a six-cylinder internal combustion engine.

Figure 8:
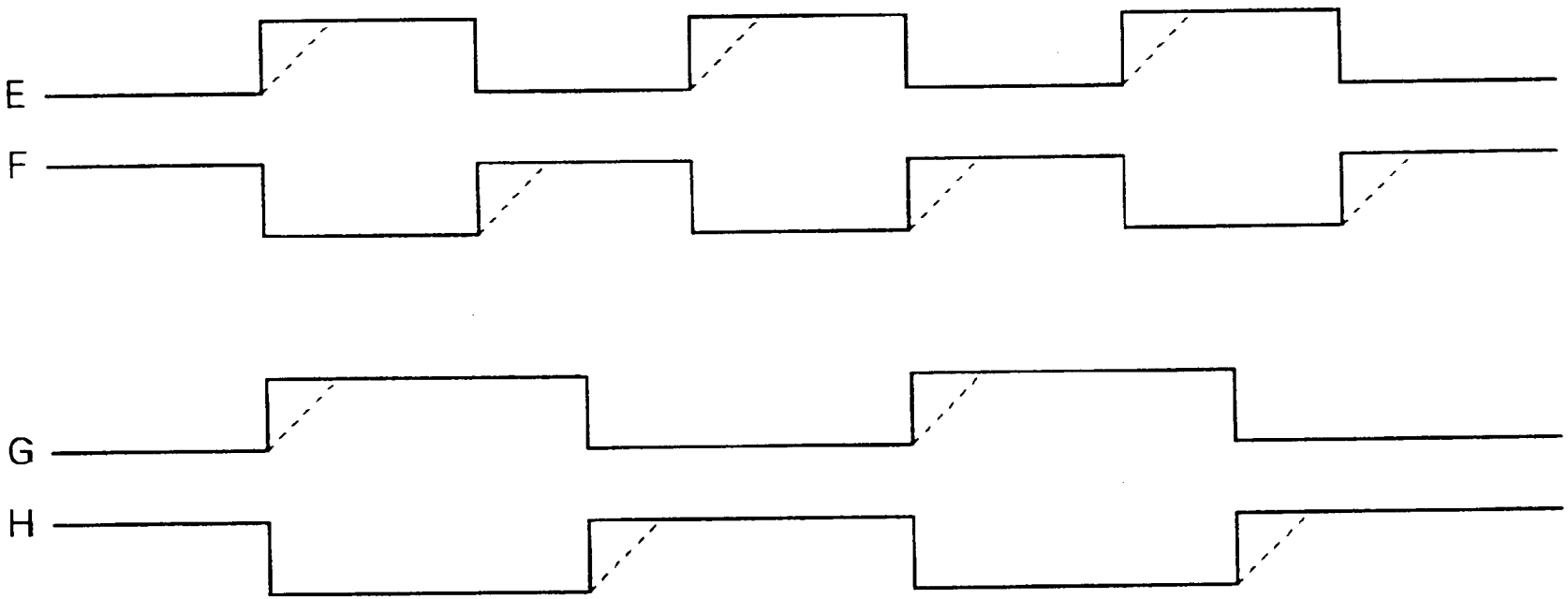
FIG. 8 is a time chart illustrating the difference in sucking/discharging operations between different frequencies in reciprocation of a plunger.

FIG. 8 is a time chart illustrating differences in suction and discharge operations for different frequencies in reciprocation of the plunger 43. Waveform E represents sucking operation for a high frequency: the portion projecting above shows a time in which the plunger 43 sucks the fuel into the fuel pressurizing chamber 45. Waveform F represents discharging operation for a high frequency: the portion projecting above shows a time in which the plunger 43 discharges the fuel from the fuel pressurizing chamber 45. That is, along with reciprocation of the plunger 43, sucking and discharging operations are alternately repeated. However, when transferring from suction to discharge operations, or from discharge to suction operations, there is a time in which the reed valve 44 transfers from closing to opening or from opening to closing, and in this period of time, suction or discharging operation is not carried out in an accurate sense of the word, which is represented by a diagonal portion shown by a dotted line.

On the other hand, waveforms G and H represent suction and discharging operations for a low frequency. In waveforms G and H, the diagonal portion indicated by a dotted line, i.e., the number of transfers of the reed valve 44 from closing to opening or from opening to closing, is small within a unit time. This means that a lower frequency leads to a more efficient functioning of the high-pressure fuel pump 3. In other words, by reducing the frequency, it is possible to facilitate an opening/closing response of the reed valve 44, and improve efficiency of the high-pressure fuel pump 3. Even with a lower frequency, the quantity of discharge can be maintained by increasing the quantity of lift of the plunger 43.

By driving the high-pressure fuel pump 3 with a relatively high frequency for a response of the valve body 63*a* of the reed valve 44, a surge pressure is produced in the fuel pressurizing chamber 45 of the high-pressure fuel pump 3. If the average pressure of the fuel pressurizing chamber 45 is increased in such a case, therefore, trouble would be caused in driving of the high-pressure fuel pump 3. If the high-pressure fuel pump 3 can be driven with a relatively low frequency to inhibit the surge pressure, on the contrary, it would be possible to improve the average discharge pressure of the pump.

The high-pressure fuel pump 3 of this embodiment has, furthermore, a three-crest cam 48 for the six-cylinder internal combustion engine as described above. That is, the number of cam crests is a half that of the cylinders of the internal combustion engine. In this state, periodicity is stabilized, and even when there is a slight pulsation, it is possible to make a setting taking account of some fluctuations by setting slight differences between cylinders in advance for the fuel injecting period by means, for example, of a control circuit.

In the fuel supplying apparatus of this embodiment, as described above, the foregoing configuration brings about a shorter distance between the high-pressure regulator 32 and the high-pressure fuel pump 3, thus minimizing the effect of the reflected wave of pulsation of the fuel, thus permitting reduction of pulsation. As a result, it is possible to stabilize the quantity of injected fuel and revolutions of the engine. The high-pressure regulator, which has conventionally been provided in the downstream of the delivery pipe 1, can be omitted, and a fuel path provided between the high-pressure regulator and the delivery pipe 1 and the fuel path provided between the high-pressure regulator and the fuel tank 2 can also be omitted, this resulting in a shorter piping and reduction of cost.

Since there is provided a high-pressure accumulator 31 which absorbs pulsation of the fuel discharged from the high-pressure fuel pump 3, the foregoing fuel pressure pulsation width can be inhibited to a minimum level. This makes it possible to stabilize the quantity of injected fuel and revolutions of the engine.

The high-pressure accumulator 31 and the high-pressure regulator 32 are integrally formed in the high-pressure fuel pump unit 200 together with the high-pressure fuel pump 3. This configuration permits reduction of the distance between them and effective inhibition of fuel pulsation. Omission of a considerable portion of piping makes it possible to achieve a more compact size of the apparatus. It is not however always necessary to form the high-pressure accumulator 31 and the high-pressure regulator 32 integrally with the high-pressure fuel pump 3. Provision of these components between the high-pressure fuel pump 3 and the delivery pipe 1 in the high-pressure fuel path 4 is sufficient to achieve the advantages of the present invention. It is needless to mention that the advantages are more remarkable when the position is closer to the high-pressure fuel pump 3 in the high-pressure fuel path 4.

Embodiment 2

Figure 9:
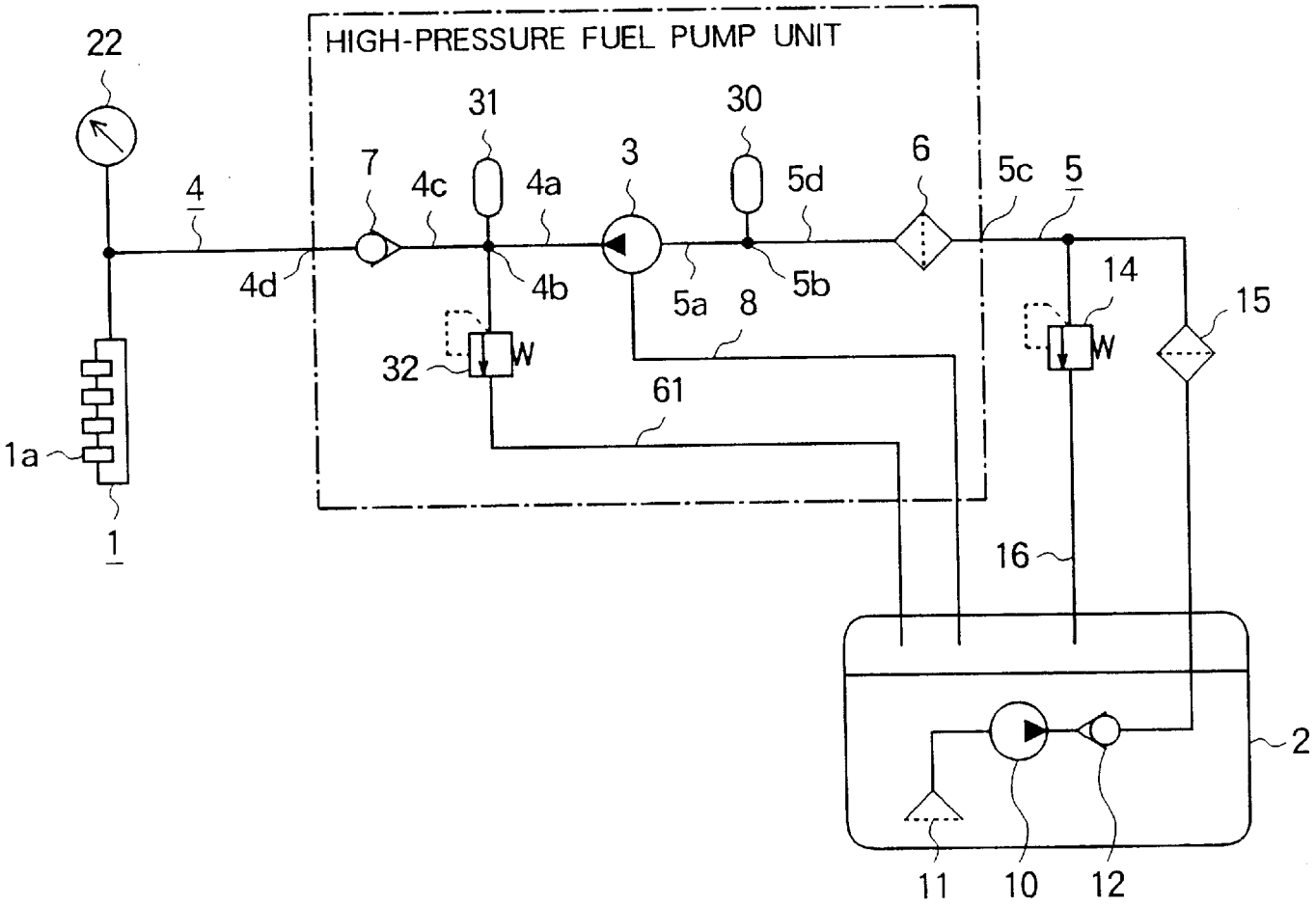
FIG. 9 is a schematic configuration diagram illustrating another embodiment of the fuel supplying apparatus of the invention.
Figure 10:
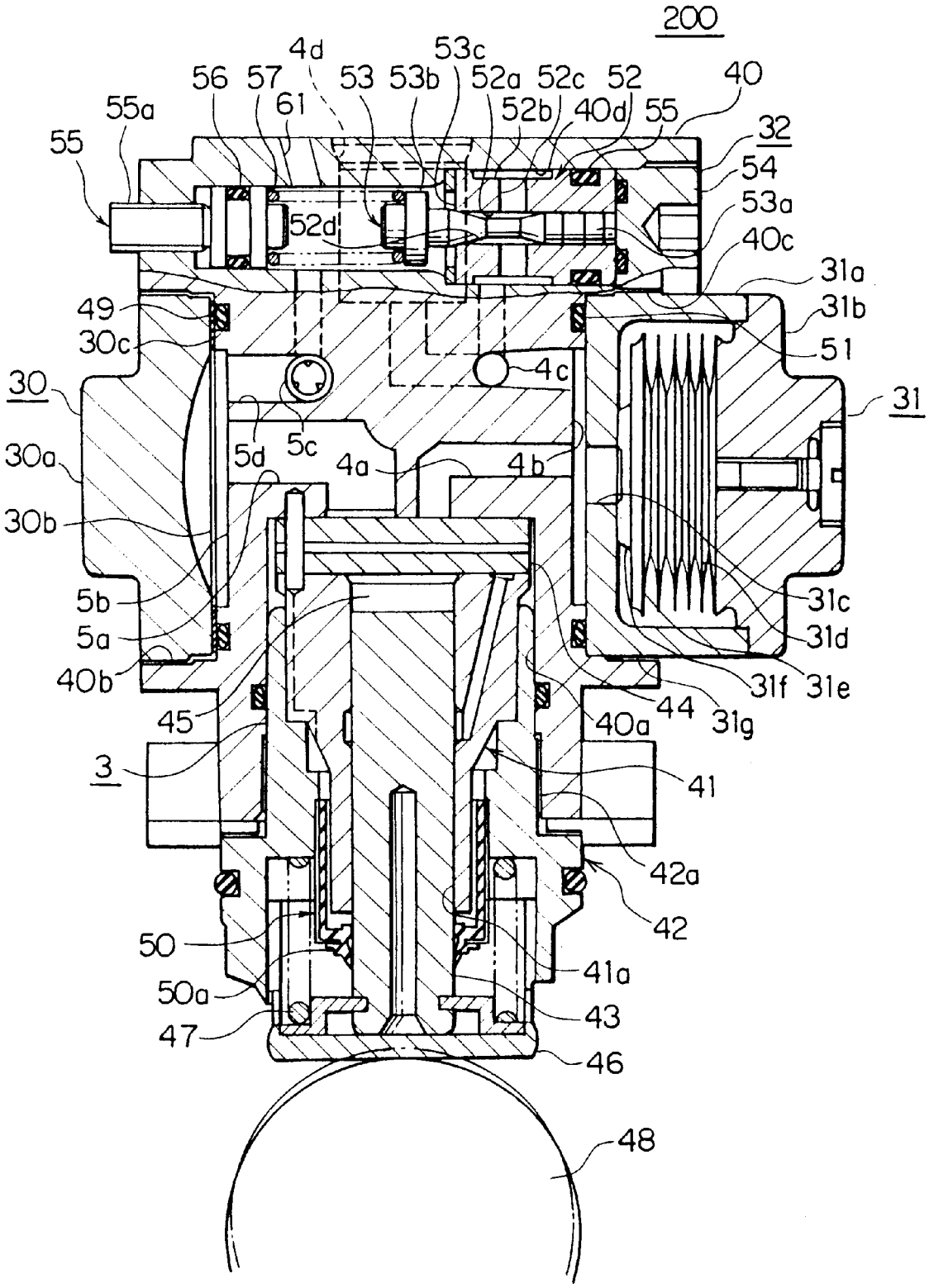
FIG. 10 is a sectional view of a high-pressure fuel pump illustrating another embodiment of the fuel supplying apparatus of the invention.

FIG. 9 is a schematic configuration diagram illustrating another embodiment of the fuel supplying apparatus of the invention; and FIG. 10 is a sectional view of a high-pressure fuel pump unit in this embodiment of the fuel supplying apparatus of the invention. In this embodiment, as shown in FIG. 9, a drain of a high-pressure regulator 32 is returned to a fuel tank 2. In FIG. 10, in a passage hole 40*d* in which a high-pressure regulator 32 is arranged, a drain 61 communicating with an external fuel tank 2 is formed in the passage hole 40*d* housing a spring 57.

Other components of the configuration are the same as in the embodiment 1 of the invention.

In the fuel supplying apparatus having the configuration as described above, the fuel discharged from the high-pressure regulator 32 is once brought back to the fuel tank 2 for cooling. The fuel is therefore never brought to a high temperature or evaporated, thus permitting stable fuel injection from a fuel injector.

Embodiment 3

Figure 11:
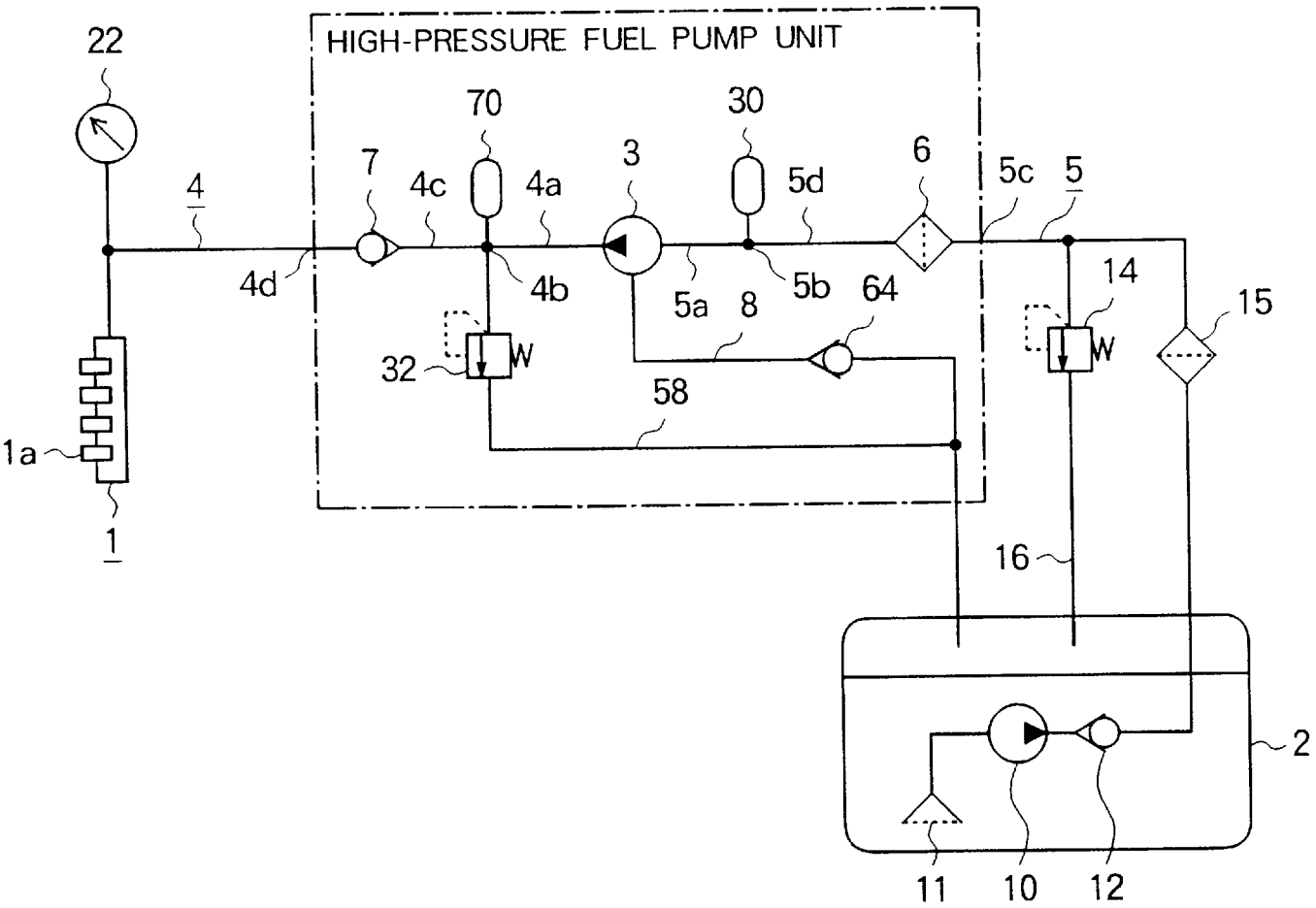
FIG. 11 is a schematic configuration diagram illustrating a further embodiment of the fuel supplying apparatus of the invention.
Figure 12:
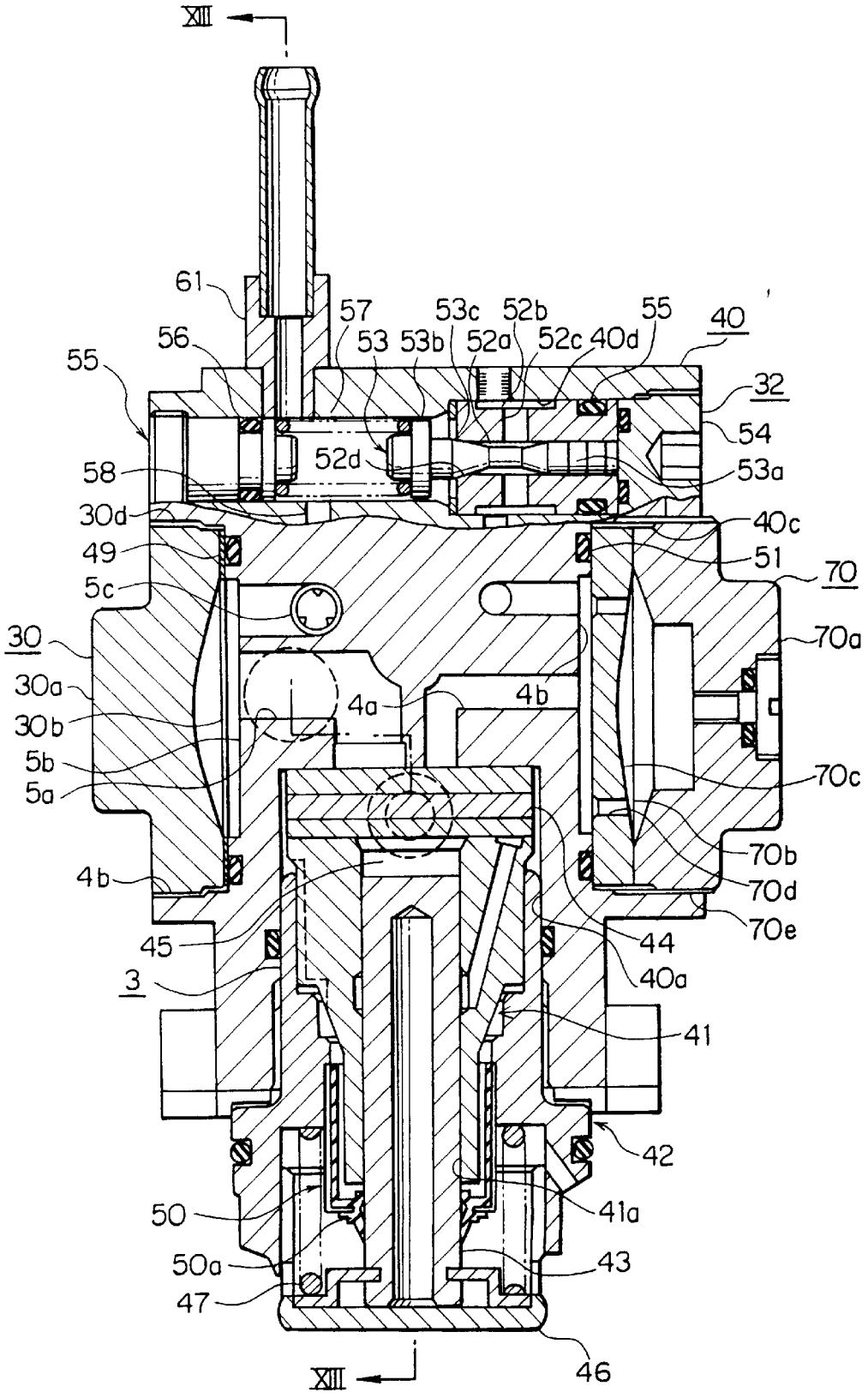
FIG. 12 is a sectional view of a high-pressure fuel pump illustrating a further embodiment of the fuel supplying apparatus of the invention.
Figure 13:
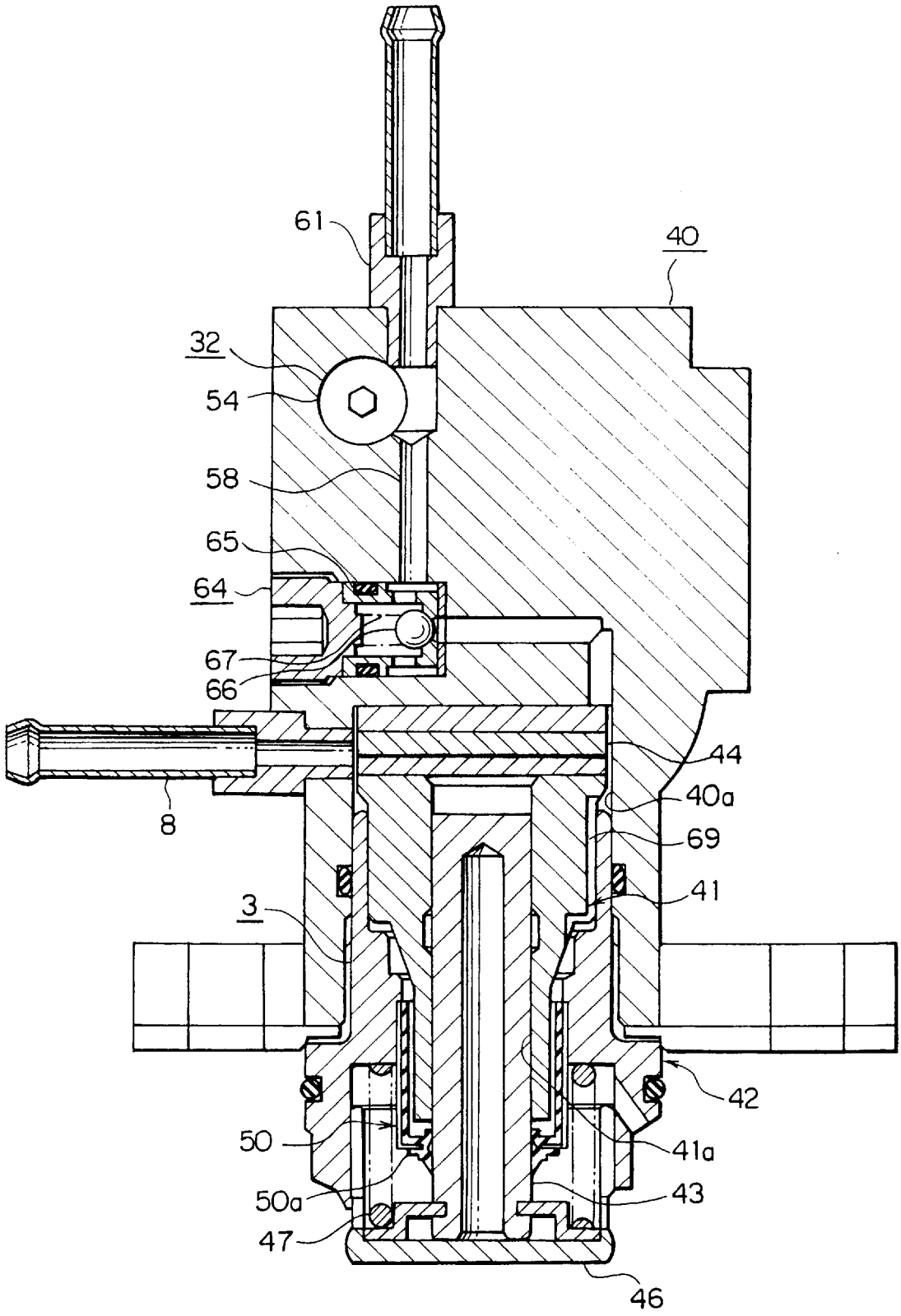
FIG. 13 is a sectional view of FIG. 12 cut along the line XIII—XIII.
Figure 14:
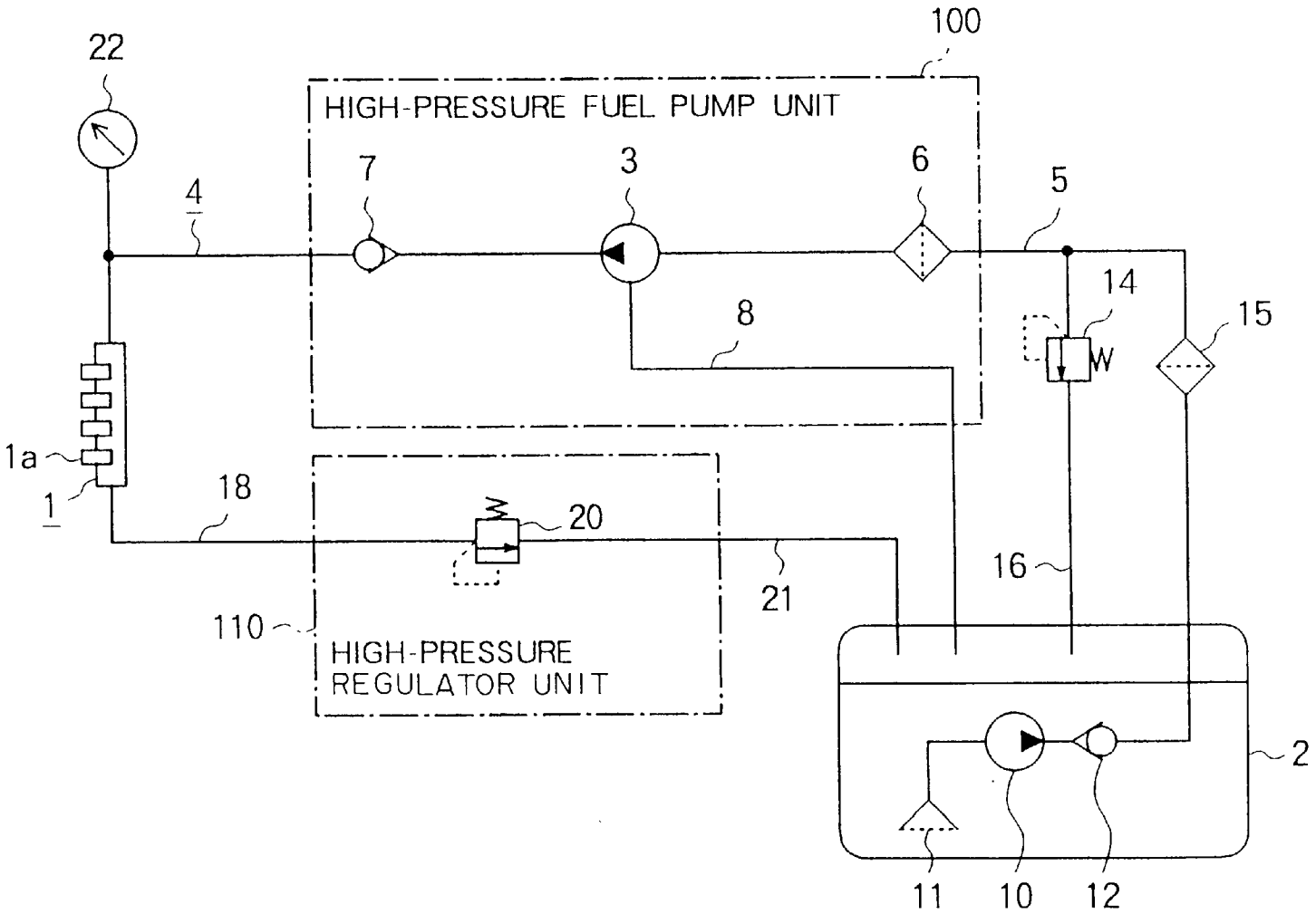
FIG. 14 PRIOR ART
FIG. 14 is a schematic configuration diagram illustrating a conventional fuel supplying apparatus.

FIG. 11 is a schematic configuration diagram illustrating a further embodiment of the fuel supplying apparatus of the invention; FIG. 12 is a sectional view of a high-pressure fuel pump unit in this embodiment of the fuel supplying apparatus of the invention; and FIG. 13 is a sectional view of FIG. 12 cut along the line XIII—XIII. As shown in FIG. 11, in this embodiment, a drain 58 of a high-pressure regulator 32 communicates with a drain 8 of a high-pressure fuel pump 3 in the high-pressure fuel pump 3, or outside the high-pressure fuel pump 3 by means, for example, of an adapter. A check valve 64 is provided in the drain 8 of the high-pressure fuel pump 3 so as to prevent return of the fuel from the high-pressure regulator 32 from going into the high-pressure fuel pump 3. A metal diaphragm type high-pressure accumulator 70 is provided on the higher pressure side of the high-pressure fuel pump 3.

In FIG. 13, in a passage hole 40*d* in which the high-pressure regulator 32 is arranged, the drain 58 communicating with a recess 40*a* of a casing 40 is formed in the passage hole 40*d* at the portion thereof housing a spring 57. A check valve 64 is provided in the middle of the drain 88. The check valve 64 has a cylindrical member 65 forming a path and a ball 66 movably arranged in the cylindrical member 65. The ball 66 is imparted with a force in the direction to the right in FIG. 13 by a spring 67, i.e., in a direction of the high-pressure fuel pump 3 of the drain 58. The cylindrical member 65 and the ball 66 regulate the fuel in the drain 58 so as to be movable only in a direction from the high-pressure fuel pump 3 toward the fuel tank 2.

In this embodiment also, the same sealing member 50 as in the embodiment 1 is provided. The sealing member 50 provides sealing for preventing the fuel leaking through a sliding surface between a cylinder 41 and a plunger 43 from flowing out. The fuel blocked by the sealing member 50 flows through a groove 69 formed on the outer periphery of the cylinder 41, reaches a space between a reed valve 44 and a recess 40*a*, and returns to a fuel tank 2 through the drain 8. The fuel discharged from the high-pressure regulator 32 reaches, on the other hand, the recess 40*a* through the drain 58, and returns to the fuel tank 2 through the drain 8.

In FIG. 12, a recess 40*c* is formed to the right of the casing 40 in the drawing. A high-pressure accumulator 70 is tightened to this recess 40*c*. A discharge path 4*b* communicating with the discharge path 4*a* is formed as a recess on the bottom of the recess 40*c*. The high-pressure accumulator 70 comprises a substantially disk-shaped thick case 70*a*, a metal diaphragm 70*b* made of a metal sheet, and a disk-shaped plate 70*c*. A gently-sloping dent is formed on a main surface of the case 70*a*. On the other hand, another gently-sloping dent is formed on a main surface of the plate 70*c*. The case 70*a* and the plate 70*c* are secured with the metal diaphragm 70*b* in between so that the both dents face each other. The metal diaphragm 70*b* and the plate 70*c* are welded together over the entire periphery of the facing surfaces and are closely connected together. A high-pressure gas is sealed in a closed space between the metal diaphragm 70*b* and the case 70*a*. One or more communicating holes for passing the fuel are pierced at prescribed positions in the plate 70*c*. A male screw 70*e* is formed on the outer periphery of the case 70*a*. In the recess 40*c*, on the other hand, a female screw engaging with the male screw 70*e* is threaded. The high-pressure accumulator 70 is sealed with an O-ring 51 and tightened to the recess 40*c* so as to communicate the communication hole 70*d* with the discharge path 4*b*.

The high-pressure accumulator 70 absorbs pulsation of the fuel discharged into the discharge path 4*b*. More specifically, during the period of discharging the fuel into the discharge path 4*b*, the metal diaphragm 70*b* travels to the right in FIG. 12 to store a part of the discharged fuel, and during the period of suction during which discharging is discontinued, releases the stored fuel by returning to the left in FIG. 12. As a result, pulsation of discharged fuel pressure of the high-pressure fuel pump 3 is reduced.

The other components are the same as in the embodiment 1.

In the fuel supplying apparatus having the configuration as described above, the high-pressure fuel pump 3 has the drain 8 communicating with the fuel tank 2, and the drain 58 of the high-pressure regulator 32 communicates with the drain 8 of the high-pressure fuel pump 3. It is consequently possible to reduce the scale of piping, thus leading to a lower cost. A simpler layout is also possible. Because the fuel returning from the high-pressure regulator 32 never flows backward to the high-pressure fuel pump 3, operation of the high-pressure fuel pump 3 is stabilized.

According to one aspect of the present invention, there is provided a fuel supplying apparatus comprising a fuel injector which injects a fuel into an internal combustion engine; a fuel tank storing the fuel; a fuel path connecting the fuel injector and the fuel tank; a low-pressure fuel pump provided at the end of the fuel path on the side of said fuel tank; a high-pressure fuel pump provided between the low-pressure fuel pump and the fuel injector of the fuel path and having a fuel suction port, a fuel discharge port, a cylinder having a hole, a fuel pressurizing chamber formed on a part of the hole, and a plunger arranged reciprocally movably in the hole, and the high-pressure fuel pump sucking the fuel from the fuel path through the suction port into the fuel pressurizing chamber for pressurizing the same and discharging the pressurized fuel from the discharge port into the fuel path to pressure-feed the discharged fuel to the fuel injector by reciprocation work of the plunger; and a high-pressure regulator, which is provided between the high-pressure fuel pump and the fuel injector of the fuel path, for adjusting pressure of the fuel discharged from the high-pressure fuel pump. As a result, the distance between the high-pressure regulator and the high-pressure fuel pump becomes shorter, and it is possible to minimize the effect of reflected wave of pulsation of the fuel and reduce pulsation. The quantity of injected fuel can be stabilized and revolutions of the engine can also be stabilized. The high-pressure regulator so far provided in the downstream of the fuel injector in the conventional art can be omitted, and it is also possible to omit the fuel path provided between this high-pressure regulator and the fuel injector and the fuel path provided between this high-pressure regulator and the fuel tank, thus making it possible to reduce the length of piping and to cut cost.

According to another aspect of the present invention, there is provided a fuel supplying apparatus comprising a fuel injector which injects a fuel into an internal combustion engine; a fuel tank for storing the fuel; a fuel path connecting the fuel injector and the fuel tank; a low-pressure fuel pump provided at the end of the fuel path on the side of said fuel tank; a high-pressure fuel pump provided between the low-pressure fuel pump and the fuel injector of the fuel path and having a fuel suction port, a fuel discharge port, a cylinder having a hole, a fuel pressurizing chamber formed on a part of the hole, and a plunger arranged reciprocally movably in the hole, and the high-pressure fuel pump sucking the fuel from the fuel path through the suction port into the fuel pressurizing chamber for pressurizing the same and discharging the pressurized fuel from the discharge port into the fuel path to pressure-feed the discharged fuel to the fuel injector by reciprocation work of the plunger; and a high-pressure accumulator, which is provided between the high-pressure fuel pump and the fuel injector of the fuel path, for absorbing pulsation of the fuel discharged from the high-pressure fuel pump. It is consequently possible to reduce pulsation and achieve a smaller pulsation width. This permits stabilization of the quantity of injected fuel and engine revolutions.

According to still another aspect of the present invention, there is provided a fuel supplying apparatus comprising a fuel injector which injects a fuel into an internal combustion engine; a fuel tank storing the fuel; a fuel path connecting the fuel injector and the fuel tank; a low-pressure fuel pump provided at the end of the fuel path on the side of said fuel tank; a high-pressure fuel pump provided between the low-pressure fuel pump and the fuel injector of the fuel path and having a fuel suction port, a fuel discharge port, a cylinder having a hole, a fuel pressurizing chamber formed on a part of the hole, and a plunger arranged reciprocally movably in the hole, and the high-pressure fuel pump sucking the fuel from the fuel path through the suction port into the fuel pressurizing chamber for pressurizing the same and discharging the pressurized fuel from the discharge port into the fuel path to pressure-feed the discharged fuel to the fuel injector by reciprocation work of the plunger; a high-pressure regulator, which is provided between the high-pressure fuel pump and the fuel injector of the fuel path, for adjusting pressure of the fuel discharged from the high-pressure fuel pump; and a high-pressure accumulator, which is provided between the high-pressure fuel pump and the fuel injector of the fuel path, for absorbing pulsation of the fuel discharged from the high-pressure fuel pump. As a result, the distance between the high-pressure regulator and the high-pressure fuel pump becomes shorter and it is possible to reduce the effect of reflected wave of fuel pulsation and minimize pulsation. The high-pressure accumulator permits further reduction of pulsation and the pulsation width. It is thus possible to stabilize the quantity of injected fuel and engine revolutions. The high-pressure regulator provided in the downstream of the fuel injector in the conventional art can be omitted. It is also possible to omit the fuel path provided between the high-pressure regulator and the fuel injector, and a fuel path provided between the high-pressure regulator and the fuel tank, thus leading to a shorter length of piping and permitting cost reduction.

According to further aspect of the present invention, there is provided a fuel supplying apparatus, wherein the high-pressure regulator is provided integrally with the high-pressure fuel pump. As a result, it is possible to further reduce the distance between the high-pressure regulator and the high-pressure fuel pump, and to further reduce the effect of the reflected wave. It suffices to use a smaller number of parts, resulting in fewer manufacturing steps and hence in a lower cost. Further, the space for installation can be saved.

According to still further aspect of the present invention, there is provided a fuel supplying apparatus, wherein the high-pressure regulator is provided integrally with the high-pressure fuel pump. As a result, it suffices to use a smaller number of parts, resulting in fewer manufacturing steps and hence in a lower cost. Further, the space for installation can be saved.

According to another aspect of the present invention, there is provided a fuel supplying apparatus, wherein the high-pressure regulator has a drain communicating with the fuel tank. As a result, the fuel discharged by the high-pressure regulator is once returned to the fuel tank for cooling. The fuel does not therefore become higher in temperature and is never evaporated. This permits stable fuel injection in the fuel injector.

According to still another aspect of the present invention, there is provided a fuel supplying apparatus, wherein the high-pressure fuel pump has a drain communicating with the fuel tank, and the high-pressure regulator has a drain communicating with the drain of the high-pressure fuel pump. As a result, the piping length can be reduced and a lower cost can be achieved. An easier layout is possible.

According to further aspect of the present invention, there is provided a fuel supplying apparatus, further comprising a check valve which is provided between the drain of the high-pressure fuel pump and the drain of the high-pressure regulator for preventing a fuel returned from the high-pressure regulator from going to the high-pressure fuel pump. As a result, the return of the fuel from the high-pressure regulator never flows backward to the high-pressure fuel pump, thus stabilizing operation of the high-pressure fuel pump.

According to still further aspect of the present invention, there is provided a fuel supplying apparatus, wherein the high-pressure fuel pump is of the single-cylinder type. This makes it possible to simplify the configuration of the high-pressure fuel pump.

According to another aspect of the present invention, there is provided a fuel supplying apparatus, wherein the number of cam crests of a cam interlocking with a crank of an internal combustion engine which serves as driving means for reciprocating the plunger is smaller than the number of cylinders of the internal combustion engine. As a result, it is possible to reduce the plunger frequency, facilitate opening/closing response of the reed valve, and improve efficiency of the high-pressure fuel pump. Since the reed valve opening/closing speed becomes lower, it is possible to reduce surge pressure in the fuel pressurizing chamber, thus permitting increase in the average pressure of the fuel pressurizing chamber.

According to still another aspect of the present invention, there is provided a fuel supplying apparatus, wherein the number of cam crests is a half the number of cylinders of the internal combustion engine. This brings about a stable periodicity, and even in the presence of a slight pulsation, variation thereof can be known at the time of setting, thus enabling to effect a setting taking account of variation.

According to further aspect of the present invention, there is provided a fuel supplying apparatus, wherein the high-pressure fuel pump supplies the fuel to an internal combustion engine of the direct gasoline injecting type. Even in an internal combustion engine using gasoline, which is poor in lubricity and has a fuel pressurizing chamber difficult to operate under a higher pressure, reduction of fuel pressure pulsation and surge pressure can be accomplished, thereby permitting effective increase in pressure.

What is claimed is:

1. A fuel supplying apparatus, comprising:

a fuel injector injecting a fuel into an internal combustion engine;

a fuel tank storing the fuel;

a fuel path connecting said fuel injector and said fuel tank;

a low-pressure fuel pump provided at the end of said fuel path on the side of said fuel tank;

a high-pressure fuel pump provided between said low-pressure fuel pump and said fuel injector of said fuel path and having a fuel suction port, a fuel discharge port, a cylinder having a hole, a fuel pressurizing chamber formed on a part of said hole, and a plunger arranged reciprocally movably in said hole, and said high-pressure fuel pump sucking the fuel from said fuel path through said suction port into said fuel pressurizing chamber for pressurizing the same and discharging the pressurized fuel from said discharge port into said fuel path to pressure-feed the discharged fuel to said fuel injector by reciprocation work of said plunger; and high-pressure regulator, which is provided between said high-pressure fuel pump and said fuel injector of said fuel path, for adjusting pressure of the fuel discharged from said high-pressure fuel pump;

wherein said high-pressure regulator is provided integrally with said high-pressure fuel pump;

wherein said high-pressure regulator has a drain communicating with said fuel tank.

2. A fuel supplying apparatus, comprising:

a fuel injector injecting a fuel into an internal combustion engine;

a fuel tank storing the fuel;

a fuel path connecting said fuel injector and said fuel tank;

a low-pressure fuel pump provided at the end of said fuel path on the side of said fuel tank;

a high-pressure fuel pump provided between said low-pressure fuel pump and said fuel injector of said fuel path and having a fuel suction port, a fuel discharge port, a cylinder having a hole, a fuel pressurizing chamber formed on a part of said hole, and a plunger arranged reciprocally movably in said hole, and said high-pressure fuel pump sucking the fuel from said fuel path through said suction port into said fuel pressurizing chamber for pressurizing the same and discharging the pressurized fuel from said discharge port into said fuel path to pressure-feed the discharged fuel to said fuel injector by reciprocation work of said plunger; and a high-pressure regulator, which is provided between said high-pressure fuel pump and said fuel injector of said fuel path, for adjusting pressure of the fuel discharged from said high-pressure fuel pump;

wherein said high-pressure fuel pump has a drain communicating with said fuel tank, and said high-pressure regulator has a drain communicating with said drain of said high-pressure fuel pump; and a check valve which is provided between said drain of said high-pressure fuel pump and said drain of said high-pressure regulator for preventing a fuel returned from said high-pressure regulator from going to said high-pressure fuel pump.

3. A fuel supplying apparatus according to claim 2, wherein said high-pressure fuel pump is of the single-cylinder type.

4. A fuel supplying apparatus according to claim 2, wherein said high-pressure fuel pump supplies the fuel to an internal combustion engine of the direct gasoline injecting type.

5. A fuel supplying apparatus, comprising:

a fuel injector injecting a fuel into an internal combustion engine;

a fuel tank storing the fuel;

a fuel path connecting said fuel injector and said fuel tank;

a low-pressure fuel pump provided at the end of said fuel path on the side of said fuel tank;

a high pressure fuel pump provided-between said low-pressure fuel pump and said fuel injector of said fuel path having a fuel port, a fuel discharge port, a cylinder having a hole, a fuel pressurizing chamber formed on a part of said hole, and a plunger arranged reciprocally movably in said hole, and said high-pressure fuel pump sucking the fuel from said fuel path through said port into said fuel pressurizing chamber for pressurizing the same and discharging the pressurized fuel from said discharge port into said fuel path to pressure-feed the discharged fuel to said fuel injector by reciprocation work of said plunger;

a high-pressure regulator, which is provided between said high-pressure fuel pump and said fuel injector of said fuel path, for adjusting pressure of the fuel discharged from said high-pressure fuel pump; and a high-pressure accumulator, which is provided between said high-pressure fuel pump and said fuel injector of said fuel path, for absorbing pulsation of the fuel discharged from said high-pressure fuel pump, wherein said high-pressure fuel pump is of a single-cylinder type.

6. A fuel supplying apparatus, comprising:

a fuel injector injecting a fuel into an internal combustion engine;

a fuel tank storing the fuel;

a fuel path connecting said fuel injector and said fuel tank;

a low-pressure fuel pump provided at an end of said fuel path on a side of said fuel tank;

a high-pressure fuel pump provided between said low-pressure fuel pump and said fuel injector of said fuel path and having a fuel suction port, a fuel discharge port, a cylinder having a hole, a fuel pressurizing chamber formed on a part of said hole, and a plunger arranged reciprocally movably in said hole, and said high-pressure fuel pump sucking the fuel from said fuel path through said suction port into said fuel pressurizing chamber for pressurizing the same and discharging the pressurized fuel from said discharge port into said fuel path to pressure-feed the discharged fuel to said fuel injector by reciprocation work of said plunger;

a high-pressure regulator, which is provided between said high-pressure fuel pump and said fuel injector of said fuel path, for adjusting pressure of the fuel discharged from said high-pressure fuel pump;

a high-pressure accumulator, which is provided between said high-pressure fuel pump and said fuel injector of said fuel path, for absorbing pulsation of the fuel discharged from said high-pressure fuel pump;

wherein said high-pressure fuel pump has a drain communicating with said fuel tank, and said high-pressure regulator has a drain communicating with said drain of said high-pressure fuel pump; and a check valve which is provided between said drain of said high-pressure fuel pump and said drain of said high-pressure regulator for preventing a fuel returned from said high-pressure regulator from going to said high-pressure fuel pump.

7. A fuel supplying apparatus, comprising:

a fuel injector injecting a fuel into an internal combustion engine;

a fuel tank storing the fuel;

a fuel path connecting said fuel injector and said fuel tank;

a low-pressure fuel pump provided at the end of said fuel path on the side of said fuel tank;

a high-pressure fuel pump provided between said low-pressure fuel pump and said fuel injector of said fuel path and having a fuel suction port, a fuel discharge port, a cylinder having a hole, a fuel pressurizing chamber formed on a part of said hole, and a plunger arranged reciprocally movably in said hole, and said high-pressure fuel pump sucking the fuel from said fuel path through said suction port into said fuel pressurizing chamber for pressurizing the same and discharging the pressurized fuel from said discharge port into said fuel path to pressure-feed the discharged fuel to said fuel injector by reciprocation work of said plunger; and a high-pressure regulator, which is provided between said high-pressure fuel pump and said fuel injector of said fuel path, for adjusting pressure of the fuel discharged from said high-pressure fuel pump;

wherein said high-pressure regulator is provided integrally with said high-pressure fuel pump;

wherein said high-pressure fuel pump is of the single-cylinder type.

8. A fuel supplying apparatus, comprising:

a fuel injector injecting a fuel into an internal combustion engine;

a fuel tank storing the fuel;

a fuel path connecting said fuel injector and said fuel tank;

a low-pressure fuel pump provided at the end of said fuel path on the side of said fuel tank;

a high-pressure fuel pump provided between said low-pressure fuel pump and said fuel injector of said fuel path and having a fuel suction port, a fuel discharge port, a cylinder having a hole, a fuel pressurizing chamber formed on a part of said hole, and a plunger arranged reciprocally movably in said hole, and said high-pressure fuel pump sucking the fuel from said fuel path through said suction port into said fuel pressurizing chamber for pressurizing the same and discharging the pressurized fuel from said discharge port into said fuel path to pressure-feed the discharged fuel to said fuel injector by reciprocation work of said plunger; and a high-pressure regulator, which is provided between said high-pressure fuel pump and said fuel injector of said fuel path, for adjusting pressure of the fuel discharged from said high-pressure fuel pump, wherein said high-pressure regulator is provided integrally with said high-pressure fuel pump, and wherein said high-pressure fuel pump supplies the fuel to an internal combustion engine of the direct gasoline injecting type.

9. A fuel supplying apparatus comprising:

a fuel injector injecting a fuel into an internal combustion engine;

a fuel tank storing the fuel;

a fuel path connecting said fuel injector and said fuel tank;

a low-pressure fuel pump provided at the end of said fuel path on the side of said fuel tank;

a high pressure fuel pump provided between said low-pressure fuel pump and said fuel injector of said fuel path having a fuel port, a fuel discharge port, a cylinder having a hole, a fuel pressurizing chamber formed on a part of said hole, and a plunger arranged reciprocally movably in said hole, and said high-pressure fuel pump sucking the fuel from said fuel path through said port into said fuel pressurizing chamber for pressurizing the same and discharging the pressurized fuel from said discharge port into said fuel path to pressure-feed the discharged fuel to said fuel injector by reciprocation work of said plunger;

a high-pressure regulator, which is provided between said high-pressure fuel pump and said fuel injector of said fuel path, for adjusting pressure of the fuel discharged from said high-pressure fuel pump; and a high-pressure accumulator, which is provided between said high-pressure fuel pump and said fuel injector of said fuel path, for absorbing pulsation of the fuel discharged from said high-pressure fuel pump, wherein said high-pressure regulator and said high-pressure accumulator are provided integrally with said high-pressure fuel pump.

* * * * *